US007181895B1

(12) United States Patent
Rozenfeld et al.

(10) Patent No.: US 7,181,895 B1
(45) Date of Patent: Feb. 27, 2007

(54) JAM TOLERANT MAIL INSERTER

(75) Inventors: Boris Rozenfeld, New Milford, CT (US); William Salancy, Norwalk, CT (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 11/301,147

(22) Filed: Dec. 12, 2005

(51) Int. Cl.
*B65B 43/30* (2006.01)

(52) U.S. Cl. ..... 53/460; 53/569; 53/284.3; 53/381.5; 53/381.6

(58) Field of Classification Search ..... 53/381.6, 53/460
See application file for complete search history.

(56) References Cited

U.S. PATENT DOCUMENTS 4,333,300 A * 6/1982 Russell ..... 53/569
4,835,941 A * 6/1989 Torii et al. ..... 53/382.1
4,955,185 A * 9/1990 Haas et al. ..... 53/460
5,651,238 A * 7/1997 Belec et al. ..... 53/504
6,164,046 A 12/2000 Werner et al.

* cited by examiner

*Primary Examiner*—John Sipos
(74) *Attorney, Agent, or Firm*—Michael J. Cummings; Steven J. Shapiro; Angelo N. Chaclas

(57) ABSTRACT

In a mailing machine where an envelope feeder is used to feed envelopes one at a time into a mail inserter and an insert feeder is used to move insert material into the envelope in the mail inserter for mail insertion, a suction cup assembly having two suction cups is used to keep the throat of the envelope in the mail inserter open. Each suction cup is movably mounted on an air actuated holder so as to allow the suction cup to move up and down to open the envelope throat. The suction cup assembly is movably mounted on a mounting stand in the mail feeder at a pivot so that the suction assembly can be rotated at the pivot so as to deflect the suction cups further away from the insert feeder if a jam involving the insert material or the envelope occurs.

7 Claims, 6 Drawing Sheets

JAM TOLERANT MAIL INSERTER

FIELD OF THE INVENTION

The present invention relates generally to a mail inserter and, more particularly, to a mail insert using one or more suction cups to open an envelope for mail insertion.

BACKGROUND OF THE INVENTION

Machines for inserting items such as sheets of paper into envelopes are known in the art. For example, Werner et al. (U.S. Pat. No. 6,164,046) discloses a mail inserter which has an envelope supply module and an insert material module disposed side-by-side from each other, mechanically linked by a table where a retrieved envelope is moved from the envelope supply module to the insertion station in a different direction. The mail inserter, as disclosed in Werner et al., is represented by a block diagram as shown in FIG. 1. As shown in FIG. 1, the mail inserter 1 has an insertion station 5 wherein insert material is inserted into a receiving envelope. The mail inserter 1 comprises an envelope supply module 10 to supply the envelopes and an insert material supply module 70 to supply the insert material. As disclosed in Werner et al., a typical insert material supply module has a plurality of feeders for separately releasing sheets of insert material onto a moving belt where the sheets of insert material are cumulated into stacks. The stacks of insert material are sequentially moved into the insertion station for insertion. From the envelope supply module 10, envelopes are retrieved one at a time by an envelope retrieval mechanism 20 and the retrieved envelope is moved toward the insertion station 5. Before reaching the insertion station 5, the flap of the retrieved envelope is opened by a flap opening mechanism 30. In the insertion station 5, the throat of the envelope is opened by a throat opening mechanism 40 so as to allow the insertion module 60 to move a pack of insert material into the receiving envelope. After the insertion is completed, the stuffed envelope is moved away from the insertion station 5. A flap closing section 50 is used to close the flap of the stuffed envelope. The closed envelope is then sealed and further processed.

As shown in FIG. 2, an envelope 90 has a flap 92. After the flap 92 is opened, a throat 98 is exposed. The throat 98 is formed by a front envelope panel 94 and a back envelope panel 96. After the flap is opened, the envelope 90 is moved to the insertion station along a direction 390. In the insertion station, the flap 92 of the envelope is typically held down by a mechanical means when the throat 98 is opened. The throat 98 can be opened by a number of different ways. For example, it can be opened by blowing a puff of air into the throat; or it can be opened by using one or more suction cups to pull up the back panel 96 of the envelope while holding down the front panel 94. Suction cups can be used to pull up the back panel 96 at two locations 42, for example. While the throat 98 of the envelope is opened, a pack of insert material 80 is moved along direction 380 into the envelope. Subsequently, the stuffed envelope 90' is closed and sealed.

Jams may occur in a mail inserter in a number of places. For example, jams may occur in the insertion station when insert material crashes into the suction cups. If crush of the inserts happens late in the cycle, the envelope transport will try to move the envelope with inserts towards the flap closing section 50, pushing material against the suction cups in the direction of envelope motion. Jams may also occur in the insertion station when the just inserted envelope crushes against the previously inserted envelope jammed in the flap closing section 50. When the moving speed of the insert material is high a crash may damage the suction cups. The damage can be serious if the insert material is thick and heavy.

It is thus advantageous and desirable to provide a method and system to reduce the damages caused to the suction cups in a jam.

SUMMARY OF THE INVENTION

In a mailing machine where an envelope feeder is used to feed envelopes one at a time into a mail inserter and an insert feeder is used to move insert material into the envelope in the mail inserter for mail insertion, a suction cup assembly having two suction cups is used to keep the throat of the envelope in the mail inserter open. Each suction cup is movably mounted on an air actuated holder so as to allow the suction cup to move up and down to open the envelope throat. The suction cup assembly is rotatably mounted on a mounting stand in the mail feeder at a pivot so that the suction assembly can be rotated at the pivot so as to move the suction cups further away from the insert feeder when a jam involving the insert material occurs. Furthermore, the suction cup assembly has a housing for rotatably mounting the air actuated holders, each at a further pivot so that each air actuated holder can be independently rotated at the respective pivot so as to move the suction cup further away from the envelope feeder when a jam involving an envelope occurs.

DETAILED DESCRIPTION OF THE INVENTION

Figure 3:
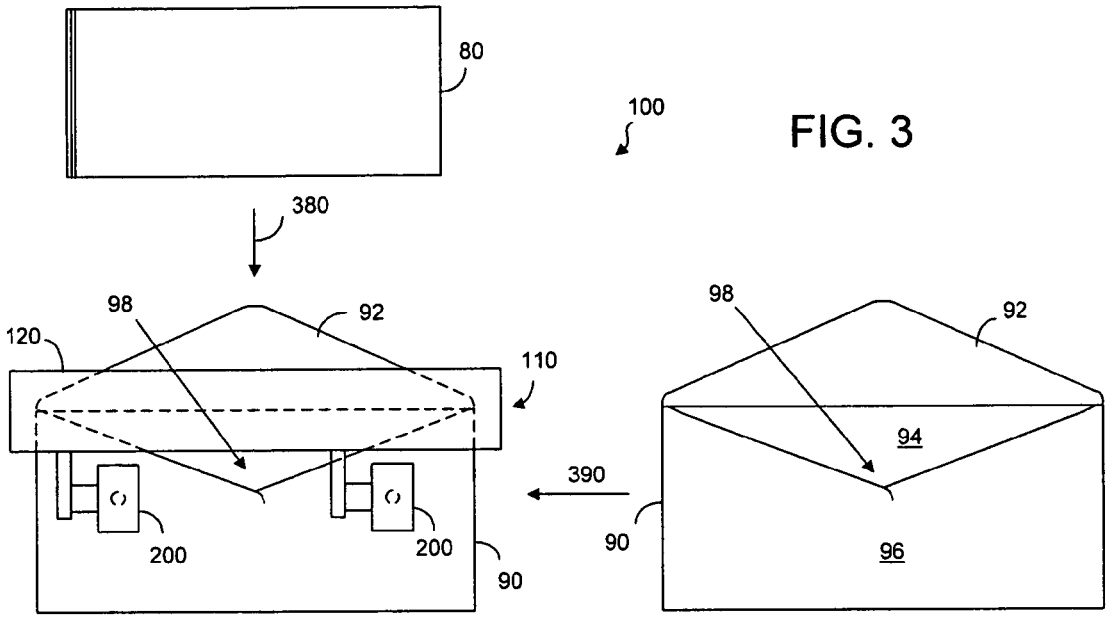
FIG. 3 shows a throat opening module, according to the present invention, in relationship to the receiving envelope and the insert material in the insertion station.

According to the present invention, the suction cups are rotatably mounted on a throat-opening module so that the impact by a crashing item can be reduced by a rotational motion about the pivot. The rotational motion allows the suction cups to move at least partially upward and away from the crashing item. As shown in FIG. 3, the throat-opening module 110, according to the present invention, comprises a housing 120 and two air actuator heads 200, each of which holds a suction cup. In that respect, each air actuator head is also a suction cup holder. The housing 200 is rotatably mounted on a stand such that when a jam caused by an incoming pack of insert material 80 occurs, the entire module 110 can be rotated about an axis substantially perpendicular to the moving direction 380 of the insert material. In addition, each of the air actuator heads 200 is rotatably mounted on the housing 120 such that when a jam caused by an outgoing inserted envelope 90 occurs, the affecting air actuator head can be rotated about an axis substantially perpendicular to the moving direction 390 of the envelope 90. As such, the impact by the crashing insert material or enveloped can be reduced.

FIGS. 4*a* to 4*d* illustrate how the throat-opening module operates and how the impact on suction cups caused by a crashing insert material can be reduced. As shown in FIGS. 4*a* to 4*d*, the throat opening module 110 has a housing 120 and two air actuator heads 200. Each of air actuator heads 200 has a suction cup 210. The housing 120 is rotatably mounted on a stand 122 at a pivot 124. The stand 122 is securely mounted on a deck. A mechanical stop (not shown) is provided on the stand 122 to allow the air actuator heads to rest against the gravity force at a desired distance from the deck below.

Figure 4A:
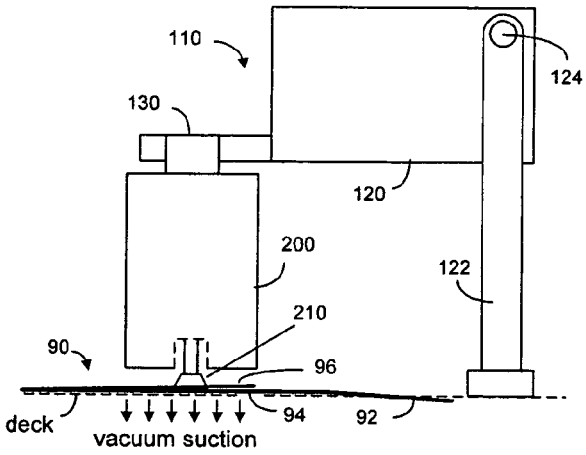
FIG. 4*a* shows a receiving envelope just entering into the insertion station.
Figure 4B:
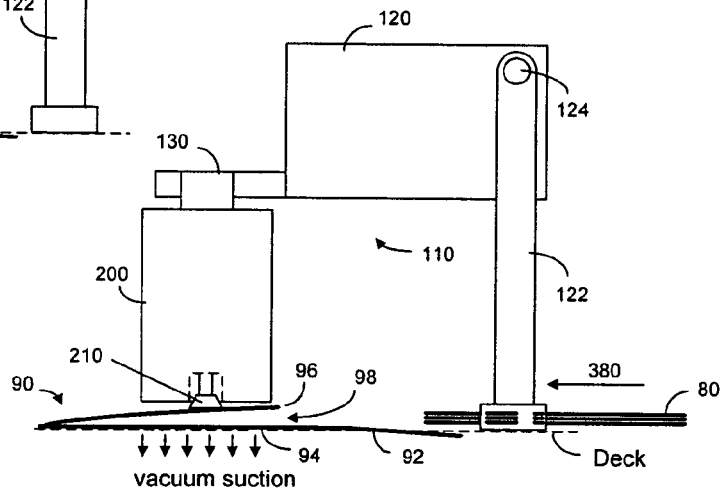
FIG. 4*b* shows the throat of the receiving envelope is opened by the throat opening module, according to the present invention.

After an envelope 90 has been moved to the designated location for mail insertion, the suction cup is lowered so that air actuated suction is applied on the envelope panel 96. At the same time, vacuum suction (always on) is also applied to the envelope panel 94 of the envelope 90. This vacuum suction is supplied to the envelope through a row of vacuum slots (not shown) located on the deck. The air suction through the vacuum slots carries two functions: 1) keeps the envelope flat, 2) holds the envelope panel 94 down while the panel 96 is pulled up to expose the throat 98, as shown in FIG. 4*b*. As the throat 98 is fully opened, the insert material 80 is moved toward the opened envelope 90 along the direction 380.

Figure 4C:
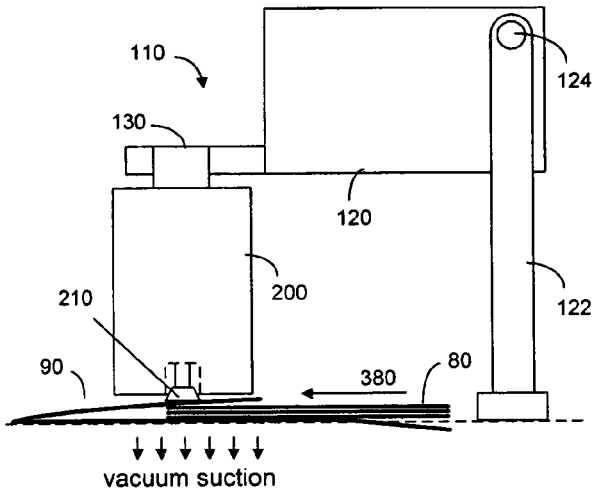
FIG. 4*c* shows a normal mail insertion.
Figure 4D:
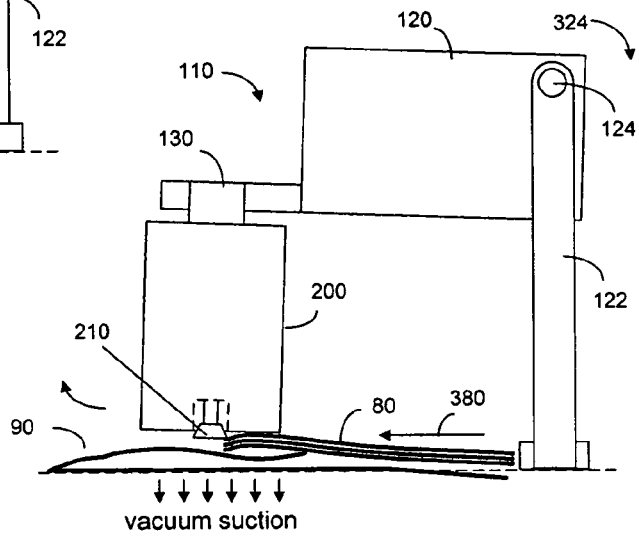
FIG. 4*d* shows a jam caused by the insert material.

In normal operation, the insert material can be inserted into the envelope 90 to complete the mail insertion process, as shown in FIG. 4*c*. However, if the insert material is buckled, for example, the insert material may miss the throat 98 of the envelope 90 and crash into the air actuator head 200. If the impact on the air actuator head 200 is sufficiently strong, it may cause the entire throat opening assembly 110 to rotate about the pivot 124 in a rotational direction 324, as shown in FIG. 4*d*. As such, the suction cup 210 is moved upward and away from deck. This movement reduces the damage on the suction cup 210 caused by the jam. The mounting of the throat-opening module 110 at the pivot 124 on the stand 122 also allows an operator to lift the air actuator head 200 away from the deck in order to clear the jam.

Figure 6A:
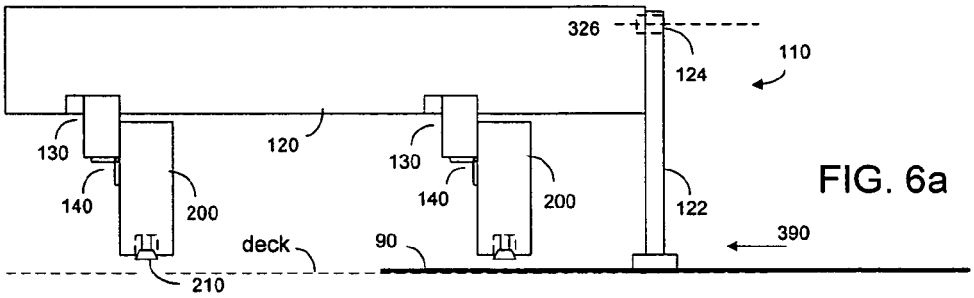
FIG. 6*a* shows an envelope entering the insertion station in a normal operation.
Figure 6B:
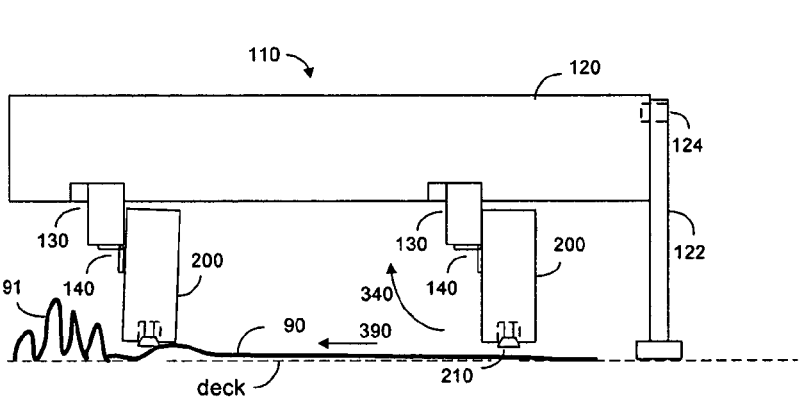
FIG. 6*b* shows a jam caused by the entering envelope.
Figure 5:
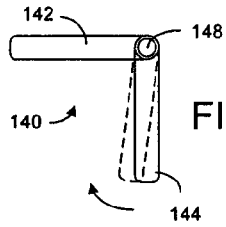
FIG. 5 shows a spring-loaded hinge for mounting an air actuator head, according to the present invention.

As shown in FIG. 6*a*, the housing 120 has two adjustable mounts 130 to suit the width and length of the envelope 90. Each air actuator head 200 is rotatably mounted on the adjustable mount 130 via a spring-loaded hinge 140. As shown in FIG. 5, each spring-loaded hinge 140 has two flat panels 142 and 144 pivotably mounted against each other at a pivot 148, allowing one panel to rotate toward the other in a rotational direction 348 about a rotational axis 248 (see FIG. 4*a*). Under normal conditions, an envelope 90 is able to move along the direction 390 under both air actuator heads 200 to reach the designated location for mail insertion. The two panels 142 and 144 maintain a 90° angle between each other, and the air actuator head 200 is maintained at a vertical position.

Figure 1:
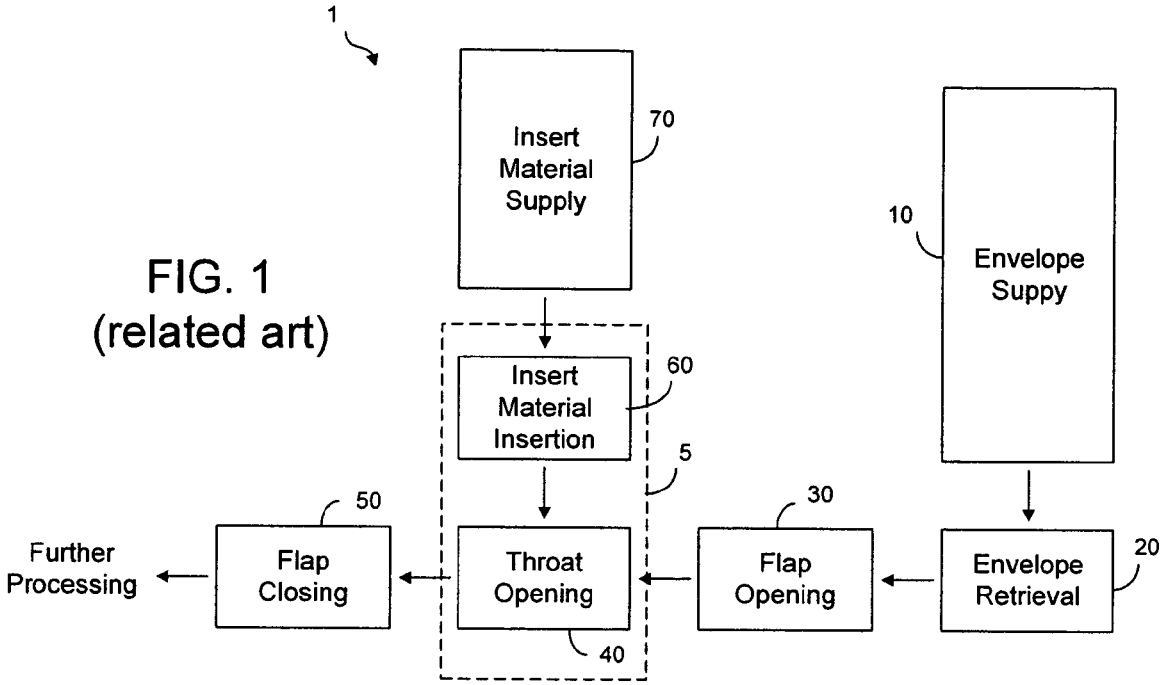
FIG. 1 (related art)
FIG. 1 is a block diagram showing the various functions in a typical mail inserter.
Figure 2:
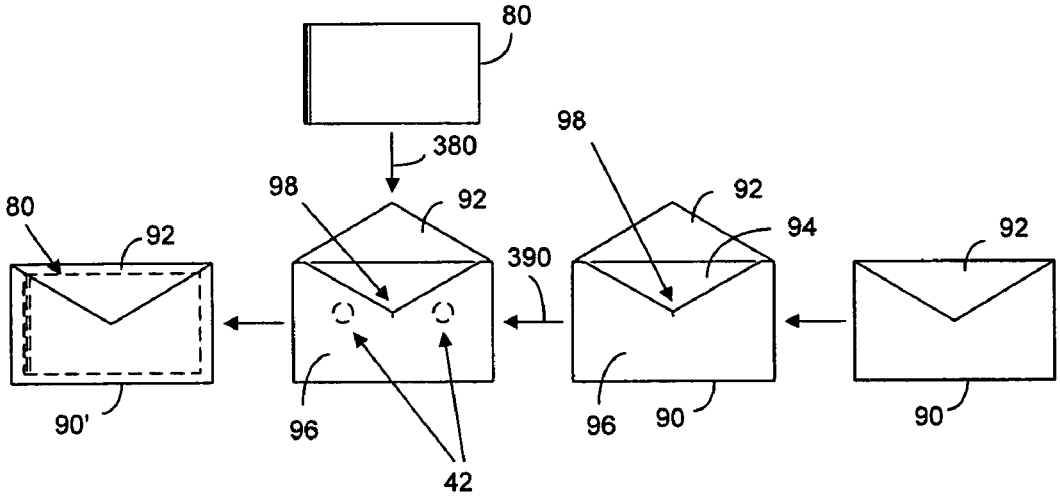
FIG. 2 (related art)
FIG. 2 shows an envelope at various stages in a typical mail inserter.

However, if the envelope 90 is buckled, as it pushes against an envelope 91 jammed in the flap closing section downstream (see FIG. 1), for example, the envelope may crash into the air actuator head 200. If the impact on the air actuator head 200 is sufficiently strong, it may be caused to rotate about the pivot 148 (see FIG. 5) along a rotational direction 348, as shown in FIG. 4*d*. As such, the suction cup 210 is moved upward and away from deck. This movement reduces the damage on the suction cup 210 caused by the jam. The mounting of the air actuator head 200 on the spring-loaded hinge 140 also allows an operator to tilt the air actuator head 200 in order to clear the jam.

In FIG. 6*a*, the rotational axis about which the throat opening assembly 110 is rotated at the pivot 124 is denoted by reference numeral 224 (see FIG. 4*d*).

It is understood that the suction cups are connected to a vacuum pump via air hoses and controlled by valves. The suction in the suction cups is discontinued before the envelope has moved into the designated location for mail insertion and after the mail insertion in the envelope is completed. The suction cups are programmed to move downward to pick up the envelope panel 96 and to move upward to open the throat 98.

Preferably, the housing 120 and the air actuator heads 200 are made of sheet metal in order to reduce the weight. It is preferable to have two suction cups to open the throat of an envelope. However, it is possible to use only one suction cup or to use three or more suction cups to open the throat. Furthermore, the present invention is also applicable to other throat opening devices, such as various mechanical members for holding the envelope open.

Thus, although the invention has been described with respect to one or more embodiments thereof, it will be understood by those skilled in the art that the foregoing and various other changes, omissions and deviations in the form and detail thereof may be made without departing from the scope of this invention.

What is claimed is:

1. A method to improve performance of a mail inserter in a mailing machine, the mail inserter having a deck, said method comprising:

providing an opening module movably mounted above and relative to the deck and carrying an opening element movable relative the module;

feeding envelopes one at a time along a first direction toward the mail inserter so as to place an envelope on the deck in the mail inserter, each envelope having a first panel, a flap connected to the first panel, and a second panel, the second and first panels defining an envelope throat;

opening the flap of the placed envelope to expose the envelope throat;

moving the opening element relative the opening module to open the exposed envelope throat;

moving insert material along a second direction toward the mail inserter so as to insert the insert material into the opened envelope throat, and deflecting the opening module relative the deck upon a jam occurring involving at least the envelope or the insert material in the mail inserter by creating pressure from the jam on the throat opening module.

2. The method of claim 1, wherein the opening element comprises at least one suction cup for opening the exposed envelope throat, and the suction cup is also deflected along with the throat opening module when the jam occurs.

3. The method of claim 2, wherein the throat opening module is rotatably mounted at a pivot in the mail inserter so that when the jam involves the envelope moving in the first direction, the throat opening module assembly is capable of being rotated about a rotational axis at the pivot such that the suction cup is pushed away from the jam substantially along the first direction and away from the deck.

4. The method of claim 2, wherein the throat opening assembly is rotatably mounted at a pivot in the mail inserter so that when the jam involves the insert material moving in the second direction, the throat opening module is capable of being rotated about a rotational axis at the pivot such that the suction cup is pushed away from the jam substantially along the second direction and away from the deck.

5. A mail inserter for use in a mailing machine, the mailing machine comprising:

a deck;

an envelope feeder for moving envelopes one at a time toward the mail inserter on a deck so as to place an envelope in the mail inserter, each envelope having a first panel, a flap connected to the first panel, and a second panel, the second and first panels defining an envelope throat; and an insert transport for moving insert material toward the mail inserter, wherein when the envelope is located in the mail inserter, the flap is open to expose the envelope throat so as to allow the insert material to move into the envelope throat for insertion; said mail inserter comprising:

a mounting structure above the deck;

a throat opening module carrying an opening element movable relative the module;

means for moving the opening element to open the envelope throat; and a mounting mechanism for movably mounting the opening module on and relative the mounting structure to allow movement of the module upon a jam occurring involving at least the envelope or the insert material in the mail inserter by creating pressure from the jam on the throat opening module.

6. The mail inserter of claim 5, wherein the throat opening module comprises:

a housing; and said opening element comprising at least one suction cup holder for movably mounting a suction cup, the suction cup dimensioned to keep the throat of the envelope opened while the insert material is moved into the throat of the envelope for insertion, wherein the mounting mechanism comprises rotatably mounting the housing on the mounting structure at a pivot so as to allow the housing to rotate about the pivot in a rotational direction to deflect the suction cup further away from the insert transport and further away from the deck.

7. The mail inserter of claim 6, wherein said at least one suction cup holder is movably mounted on the housing at another pivot so as to allow the suction cup holder to rotate about the other pivot in a rotational direction to deflect the suction cup further away from the envelope feeder and further away from the deck.

* * * * *